US008211244B2

(12) United States Patent
Kaneko et al.

(10) Patent No.: US 8,211,244 B2
(45) Date of Patent: Jul. 3, 2012

(54) TANTALUM CARBIDE, METHOD FOR PRODUCING TANTALUM CARBIDE, TANTALUM CARBIDE WIRING AND TANTALUM CARBIDE ELECTRODE

(75) Inventors: Tadaaki Kaneko, Sanda (JP); Yasushi Asaoka, Sanda (JP); Naokatsu Sano, Sanda (JP)

(73) Assignee: Toyo Tanso Co., Ltd., Osaka-shi (JP)

( * ) Notice: Subject to any disclaimer, the term of this patent is extended or adjusted under 35 U.S.C. 154(b) by 35 days.

(21) Appl. No.: 12/781,501

(22) Filed: May 17, 2010

(65) Prior Publication Data

US 2010/0284895 A1 Nov. 11, 2010

Related U.S. Application Data

(62) Division of application No. 10/566,652, filed as application No. PCT/JP2004/011325 on Jul. 30, 2004.

(30) Foreign Application Priority Data

Aug. 1, 2003 (JP) ..... 2003-284708

(51) Int. Cl.
*C23C 8/00* (2006.01)
*C01B 31/30* (2006.01)

(52) U.S. Cl. ..... 148/206; 423/440; 148/207

(58) Field of Classification Search ..... 423/440; 148/206, 207

See application file for complete search history.

(56) References Cited

U.S. PATENT DOCUMENTS 3,163,563 A 12/1964 Douglass et al.
3,586,303 A 6/1971 Lee
5,126,206 A 6/1992 Garg et al.
5,372,655 A 12/1994 Preisser et al.
5,383,981 A 1/1995 De Pruneda
5,916,377 A 6/1999 Lopez et al.
5,973,400 A 10/1999 Murakami et al.

FOREIGN PATENT DOCUMENTS

JP 56-79449 6/1981
JP 6-49619 2/1994
JP 6-87656 3/1994
JP 7-330351 12/1995

(Continued)

OTHER PUBLICATIONS

European Office Action dated Oct. 8, 2010 in corresponding European Application No. 04 771 326.8.

Rocher, M. et al., "Modelling of the growth of carbide layers in tantalum", Key Engineering Materials, vols. 206-213, Part 1, pp. 527-530, 2002.

(Continued)

*Primary Examiner* — Jessee R. Roe

(74) *Attorney, Agent, or Firm* — Oblon, Spivak, McClelland, Maier & Neustadt, L.L.P.

(57) ABSTRACT

The present invention relates to a method for manufacturing tantalum carbide which can form tantalum carbide having a prescribed shape using a simple method, can form the tantalum carbide having a uniform thickness even when the tantalum carbide is coated on the surface of an article and is not peeled off by a thermal history, tantalum carbide obtained by the manufacturing method, wiring of tantalum carbide, and electrodes of tantalum carbide, where the tantalum carbide is formed on the surface of tantalum or a tantalum alloy by placing the tantalum or tantalum alloy in a vacuum heat treatment furnace, heat-treating the tantalum or tantalum alloy under a condition where a native oxide layer of $Ta_2O_5$ formed on the surface of tantalum or tantalum alloy is sublimated to remove the $Ta_2O_5$, introducing a carbon source into the vacuum heat treatment furnace, and then heat-treating.

7 Claims, 10 Drawing Sheets

FOREIGN PATENT DOCUMENTS

| | | |
|---|---|---|
| JP | 8-64110 | 3/1996 |
| JP | 10-245285 | 9/1998 |
| JP | 11-116399 | 4/1999 |
| JP | 2000-44222 | 2/2000 |
| JP | 2000-265274 | 9/2000 |

OTHER PUBLICATIONS

Kharatyan, S.L. et al., "Kinetics of Tantalum Carbidization", Soviet Journal of Chemical Physics, vol. 8, Part 8, pp. 1881-1892, 1991.

Tsutsumoto, Takahiro et al., "Improvement of Ta filament for diamond CVD", Thin Solid Films, vol. 317, pp. 371-375, 1998.

TaC surface hardness 2200Hv (conventional figure 1550)

(2000°C, 3hr)

Fibrous crystals are folded.

The fibrous crystals grow in the same direction in the same layer, and there is a layer in which the other fibrous crystals grow in the direction different from the growing direction. One crystal structure is produced by the overlapping of the crystals.

Ta–C Phase Diagram

TANTALUM CARBIDE, METHOD FOR PRODUCING TANTALUM CARBIDE, TANTALUM CARBIDE WIRING AND TANTALUM CARBIDE ELECTRODE

CROSS-REFERENCE TO RELATED APPLICATIONS

This application is a divisional application of prior U.S. patent application Ser. No. 10/566,652, the disclosure of which is incorporated by reference in its entirety. U.S. Ser. No. 10/566,652 claims the benefit of priority from prior Japanese Patent Applications No. 2003-284708, filed Aug. 1, 2003, the entire contents of both of which are incorporated herein by reference.

TECHNICAL FIELD

The present invention relates to tantalum carbide, a method for manufacturing the tantalum carbide, wiring of the tantalum carbide and electrodes of the tantalum carbide.

BACKGROUND ART

Tantalum carbide, for example, TaC has the highest melting point among transition metal carbides and high chemical stability. FIG. 10 shows a phase diagram of TaC. The application of the TaC has been conventionally sought for various applications under a high temperature atmosphere, and manufacturing methods due to various methods have been reported.

Examples of conventional methods for manufacturing TaC include the following.

Patent Document 1: Japanese Published Unexamined Patent Application No. 6-87656

Patent Document 2: Japanese Published Unexamined Patent Application No. 2000-44222

Patent Document 3: Japanese Published Unexamined Patent Application No. 8-64110

Patent Document 4: Japanese Published Unexamined Patent Application No. 7-330351

Patent Document 5: Japanese Published Unexamined Patent Application No. 10-245285

Patent Document 6: Japanese Published Unexamined Patent Application No. 2000-265274

Patent Document 7: Japanese Published Unexamined Patent Application No. 11-116399

Patent Document 8: U.S. Pat. No. 5,383,981

For example, the Patent Document 1 describes the following method. TaC powder of fine powder and fine powder of other compounds such as HfC, ZrC and HfN are mixed. The mixture is sintered at 2000° C. in a vacuum of approximately 1 Pa to form a solid solution of TaC and other compounds. A fine TaC sintered body is produced by controlling the grain growth of TaC.

The Patent Document 2 describes the following method. Tantalum oxide ($Ta_2O_5$) and carbon are mixed, and a primary carbonization is performed at a prescribed temperature in a hydrogen furnace. The amount of free carbon of the obtained carbide is measured. The amount of carbon is then adjusted based on the measurement result, and the carbon is added to a primary carbide. A secondary carbonization is then performed at a prescribed temperature in a vacuum carbonization furnace to manufacture TaC.

The Patent Document 3 describes the following method. Metal Ta is evaporated in a vacuum, and $C_2H_2$ gas is simultaneously introduced. Both are reacted at a pressure/layer formation speed of $6.0\times10^{-2}$ Pa·min/μm during vapor deposition by a reactant ion plating method to coat a TaC layer having a composition ratio of $1<C/Ta<1.2$, excelling in a heat resistance, providing a radiation current stably even in a state of poor vacuum, and having a long life on the surface of an electron emitting material made of tungsten.

The Patent Document 4 describes a mold release layer coated on the surface of a metal mold used when a highly precise glass optical element such as a lens and a prism is press-molded. The mold release layer is one kind selected from (a) a ceramic material composed by 50 to 99 mol % of chromic oxide and 1 to 50 mol % of tantalum oxide, (b) a ceramic material composed by 50 to 99 mol % of chromium nitride and 1 to 50 mol % of tantalum nitride, (c) a ceramic material composed by 50 to 99 mol % of chromium carbide and 1 to 50 mol % of tantalum carbide.

The Patent Document 5 describes a carbon composite material for a reducing atmosphere furnace capable of exhibiting an excellent reduction gas reaction controlling effect even in a hot reduction gas atmosphere exceeding 1000° C., and capable of prolonging a product life significantly. The carbon composite material is used as the layer of the tantalum carbide formed on the surface of a graphite substrate by an arc ion plating (AIP) type reactive deposition method using metal tantalum and reactive gas.

The Patent Document 6 describes a method for forming a conductive Ta layer by a CVD method using a conductive Ta layer forming material containing a compound having Ta and a hydrocarbon solvent.

The Patent Document 7 describes the following method. A Ta substrate is arranged on the inner wall of a crucible made of graphite. The crucible is filled with carbon powder so as to come into contact with the Ta substrate to cover the Ta substrate. Then, the crucible made of graphite is heated to carbonize the Ta substrate, and TaC is coated on the inner wall of the crucible made of graphite.

The Patent Document 8 describes the following method. A carbon source is applied to the surface of Ta or Ta alloy in a vacuum furnace heated at 1300° C. to 1600° C. to form a TaC and $Ta_2C$ layer. A TaC is then formed by performing high temperature annealing heating in a vacuum so that unreacted carbon atoms adhered to the surface are diffused in the Ta substrate to perform a carbonization treatment.

However, since the TaC powder of fine powder and the fine powder of other compounds such as HfC, ZrC and HfN are mixed, and sintered at 2000° C. in a vacuum of approximately 1 Pa and to produce TaC, the Patent Document 1 has a problem that the formation of TaC having an optional shape is difficult.

Since $Ta_2O_5$ and C are mixed and TaC is formed by two carbonization treatments after molding, the Patent Document 2 has a problem that it is difficult to form TaC having a prescribed shape as in one of the above Patent Document 1.

Since the layer of TaC is formed on the outer circumferential surface of the tungsten filament and the interface with the substrate such as tungsten is inevitably formed, it is difficult to avoid the generation of cracks and exfoliation or the like of TaC in the Patent Document 3.

One described in the Patent Document 4 is formed as a layer on the surface of the substrate as in one described in the Patent Document 3, and it is difficult to avoid cracks and exfoliation or the like of the ceramic material or the like composed by 50 to 99 mol % of the chromic oxide formed on the surface and 1 to 50 mol % of the tantalum oxide as in the Patent Document 3.

Since one described in the Patent Document 5 is obtained by forming TaC on the surface of the graphite material as the substrate by the arc ion plating type reactive deposition method, the interface between the substrate and the TaC is clearly formed as in ones described in the Patent Documents 3 and 4, and it is difficult to avoid cracks and exfoliation or the like of TaC.

Since one described in the Patent Document 6 is also obtained by forming the conductive Ta layer using the CVD method, and the interface between the substrate and the conductive Ta layer is formed as well as ones described in the above Patent Documents 3 to 5, it is difficult to avoid cracks and exfoliation or the like of the conductive Ta layer by a thermal history or the like.

In the Patent Document 7, TaC is formed on the surface of Ta by directly contacting Ta with carbon powder and by heat-treating them. It is considered that the boundary of Ta and TaC appears clearly though there is no particular description in the description. Thereby, the TaC layer may be peeled off by the thermal history.

In the Patent Document 8, as shown in FIG. 5A to FIG. 5F of the description, the $Ta_2C$ layer also disappears by diffusing the unreacted carbon atom existing on the surface into the Ta substrate by high temperature annealing after the formation of a $Ta_2C$ and TaC layer, and the bulk crystal of TaC having approximately twice the thickness as one before the annealing is formed. The boundary between the Ta substrate and the TaC is clearly divided in the enlarged photograph observation. Thereby, it is considered that the delamination between the layers and the crack of the TaC layer are easily generated by the heat stress received repeatedly though there is no description in the description.

Even if the native oxide layer $Ta_2O_5$ of the surface of the Ta substrate is reacted with the carbon atoms at a low temperature of 1300° C. to 1600° C., the native oxide layer of $Ta_2O_5$ is chemically stable, the carbonization speed of Ta is low, and the diffusion depth of the carbon atoms is very shallow. Thereby, even if the carbon atoms are diffused and the TaC layer is grown by performing the vacuum heating annealing for tens of hours, a desired thickness is not obtained. Simultaneously, crystal grains grow greatly by heating for a long period of time to be formed in a bulk shape, and the boundary is also larger. It is considered that the boundary between the Ta substrate and TaC is clearly divided, and the delamination between the layers and the crack in the TaC layer are easily generated.

SUMMARY OF THE INVENTION

The present invention has been accomplished in view of the foregoing problems. It is an object of the present invention to provide a method for manufacturing tantalum carbide which can form tantalum carbide having a prescribed shape and a desired thickness by a simple method, can form the tantalum carbide having a uniform thickness even when the tantalum carbide is coated on the surface and is not peeled off by a thermal history, the tantalum carbide obtained by the manufacturing method, wiring of the tantalum carbide, and electrodes of the tantalum carbide.

The present invention mainly has some of the following features so as to attain the above objects. The present invention is provided with the following main features used alone or in combination thereof.

A method for manufacturing tantalum carbide of the present invention, comprising the steps of: placing tantalum or a tantalum alloy in a vacuum heat treatment furnace; heat-treating the tantalum or tantalum alloy under a condition where a native oxide layer of $Ta_2O_5$ formed on a surface of the tantalum or tantalum alloy is sublimated to remove the native oxide layer of $Ta_2O_5$; introducing a carbon source into the vacuum heat treatment furnace to form the tantalum carbide from the surface of the tantalum or tantalum alloy.

According to the above method for manufacturing the tantalum carbide, the purity of the tantalum carbide formed on the surface can be improved since the carbon source is introduced after the native oxide layer formed on the surface is removed under a vacuum environment, and the tantalum carbide formed on the surface of the tantalum can be almost uniformly formed on the entire surface.

The tantalum carbide of the present invention is manufactured by the method for manufacturing the tantalum carbide of the present invention.

The tantalum carbide is formed by penetration of carbon into some areas of the tantalum or tantalum alloy. In such a case, the tantalum carbide has a laminated structure where $Ta_2C$ and TaC are laminated in this order on the surface of the tantalum or tantalum alloy.

Furthermore, the tantalum carbide may be TaC formed by penetration of carbon into all areas of the tantalum or tantalum alloy by the advanced penetration of the carbon.

When the tantalum carbide has a laminated structure where $Ta_2C$ and TaC are laminated in this order on the surface of the tantalum or tantalum alloy, since Ta, $Ta_2C$ and TaC have a different lattice constant respectively, it is considered that the lattice of each of the layers is compressed and the layers are laminated at the interfaces between the layers. Therefore, the delamination can also be prevented and mechanical properties such as surface hardness can also be improved since the interfaces between the layers are very firmly formed.

In a three-layer structure, a Ta substrate of a first layer is provided with high electrical conductivity and thermal conductivity of Ta. $Ta_2O$ of a second layer plays a role of prevention of interference layer like exfoliation and cracks. TaC of a third layer is provided with properties of a high melting point and high hardness, and the arrival of a high performance material is expected by a comprehensive synergistic effect.

Therefore, since manufacturing of a product having higher properties than the high melting point, high hardness, high electrical conductivity and thermal conductivity as the properties of TaC manufactured by the conventional method can be expected, the present invention can be applied for various uses such as machining tools and electronic materials.

The method for manufacturing the tantalum carbide according to the present invention is a heat treatment method for measuring change of an emissivity when the native oxide layer is removed using a pyrometer.

According to the method for manufacturing the tantalum carbide of the above present invention, when the native oxide layer is sublimated and is removed by increasing temperature in vacuum, Ta is exposed, the emissivity is increased, and the apparent temperature is raised. After confirming the change of the emissivity measured by a pyrometer and the native oxide layer of the surface is removed, the supply of a carbon source is started into the vacuum furnace.

A heat treatment time and other process parameters for supplying the carbon source can be correctly adjusted based on a condition of the native oxide layer being removed. Thereby, a thickness of the tantalum carbide capable of being formed can be controlled.

In the method for manufacturing the tantalum carbide of the present invention, the thickness of the tantalum carbide capable of being formed is controlled by adjusting the temperature, time and pressure conditions for introducing the carbon source into the vacuum heat treatment furnace and heat-treating the tantalum or tantalum alloy processed into an optional shape.

According to the above manufacturing method of the tantalum carbide of the present invention, the thickness of the tantalum carbide can be controlled by adjusting the heat treatment temperature, time and pressure conditions. Thereby, tantalum carbide having a desired thickness can be obtained by previously forming and processing the Ta or Ta alloy easily processed into the prescribed shape, carbonizing and heat-treating the Ta or Ta alloy, and adjusting the heat treatment time, the temperature and the pressure or the like. The thickness is increased, and finally, the entire material can also serve as TaC.

In the method for manufacturing the tantalum carbide of the present invention, the heat treatment condition under a condition where the native oxide layer of $Ta_2O_5$ is sublimated is preferably at a temperature from 1750° C. to 2000° C. and a pressure of 1 Pa or lower. The temperature is more preferably from 1860° C. to 2000° C., and the pressure is more preferably 0.5 Pa or lower. With this condition, the native oxide layer of $Ta_2O_5$ is securely sublimated by the heat treatment.

In addition, it is preferable that the temperature is from 1860° C. to 2500° C., and the pressure is 1 Pa or lower referring to the heat treatment conditions where the carbon source is introduced after the native oxide layer is removed. It is more preferable that the temperature is from 2000° C. to 2500° C., and the pressure is 0.5 Pa or lower.

A wiring of the carbide tantalum according to the present invention is manufactured by the application of the method for manufacturing the tantalum carbide according to the present invention.

Specifically, the wiring of tantalum carbide of the present invention is formed by patterning tantalum or a tantalum alloy into a prescribed shape on a semiconductor substrate, heat-treating the tantalum or tantalum alloy under a condition where a native oxide layer of $Ta_2O_5$ formed on a surface of the patterned tantalum or patterned tantalum alloy is sublimated, removing the $Ta_2O_5$ from the surface of the patterned tantalum or patterned tantalum alloy, heat-treating the tantalum or tantalum alloy by introducing a carbon source, and penetrating carbon from the surface of the patterned tantalum or patterned tantalum alloy.

The wiring of the tantalum carbide is preferably TaC formed by penetration of carbon into all areas of the patterned tantalum or patterned tantalum alloy.

A carbide electrode of tantalum according to the present invention is manufactured by the application of the method for manufacturing the tantalum carbide according to the present invention.

Specifically, the electrode of the tantalum carbide of the present invention is formed by processing tantalum or a tantalum alloy into a prescribed shape, heat-treating the tantalum or tantalum alloy under a condition where a native oxide layer of $Ta_2O_5$ formed on the surface of the processed tantalum or tantalum alloy is sublimated, removing the $Ta_2O_5$, heat-treating the tantalum or tantalum alloy by introducing a carbon source, and penetrating carbon from the surface of the processed tantalum or processed tantalum alloy.

The electrode of tantalum carbide is preferably TaC formed by penetration of carbon into all areas of the tantalum or tantalum alloy processed into a prescribed shape.

The electrode of tantalum carbide of the present invention is suitable for a filament of the tantalum carbide or a heater of the tantalum carbide.

As described above, since the manufacturing method of the tantalum carbide according to the present invention can form the tantalum carbide having the prescribed shape by a simple method, and cracks and exfoliation or the like of the tantalum carbide are not generated, properties such as the excellent high melting point, high hardness, mechanical properties and electrical properties or the like of the tantalum carbide, for example, TaC can be reliably exhibited, and the application for various uses can be easily performed.

BEST MODE FOR CARRYING OUT THE INVENTION

Hereafter, an embodiment of the present invention will be described based on the drawings.

Figure 1:
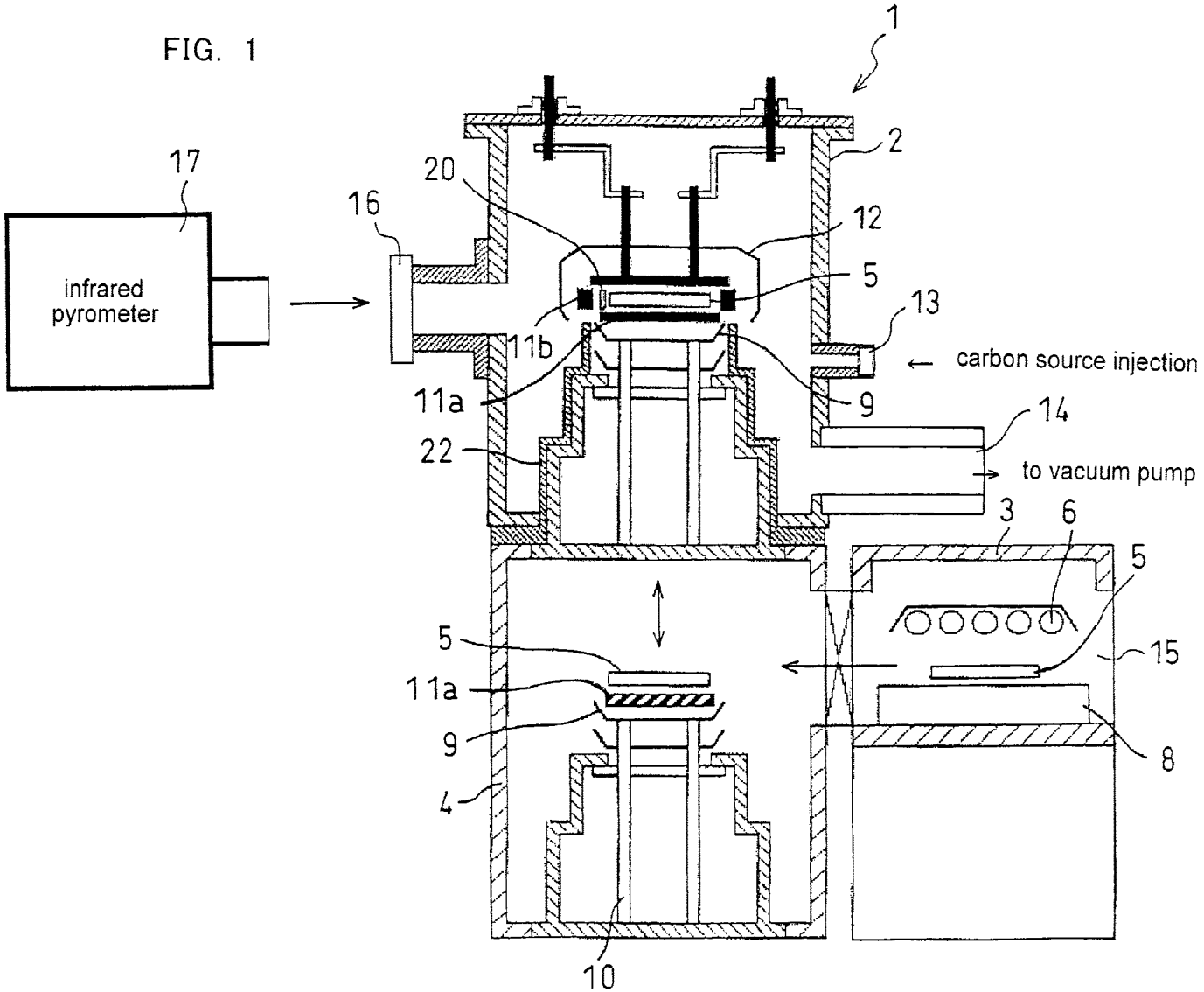
FIG. 1 is a view showing the overview of a vacuum heating furnace used for the method for manufacturing the tantalum carbide according to an embodiment of the present invention.

FIG. 1 shows the overview of a vacuum heating furnace used for the method for manufacturing the tantalum carbide according to an embodiment of the present invention. In FIG. 1, the reference numeral 1 denotes a vacuum heat treatment furnace such as a vacuum heating furnace, 2 denotes a vacuum chamber, 3 denotes a preheating chamber, 4 denotes a conveying chamber, 5 denotes a substrate of the tantalum or tantalum alloy, 6 denotes a preheating lamp, 8 denotes a support base, 9 denotes a conveying tray, 10 denotes a boarding ramp, 11*a* denotes a carbon tray serving as a thermal insulation protecting member, 11*b* denotes a thermal insulation protecting member, 12 denotes a heat reflecting plate, 13 denotes a carbon source inlet, 14 denotes a vacuum pump end connection, 15 denotes a port opening of a substrate 5, 16 denotes a window for measuring temperature or the like, numeral 17 denotes an infrared pyrometer, 20 denotes a carbon heater, and 22 denotes a sealing member for sealing between the conveying chamber 4 and the vacuum chamber 2.

Figure 2:
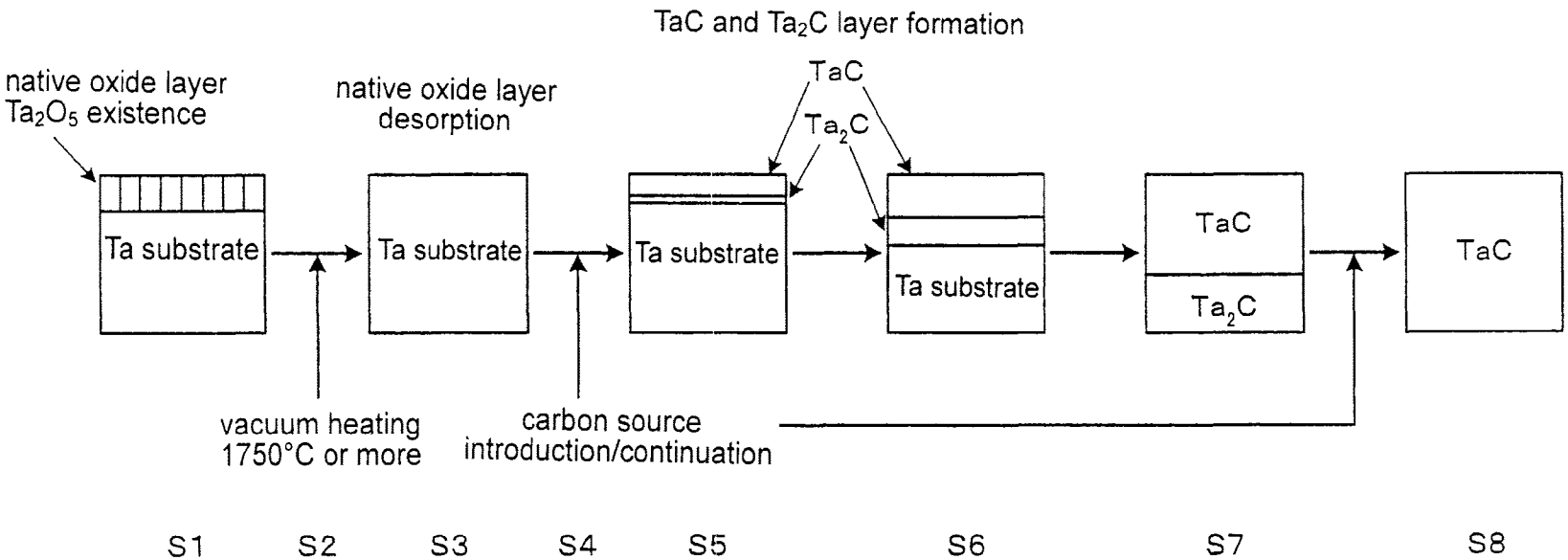
FIG. 2 is a view showing a flow chart of the method for manufacturing the tantalum carbide according to the embodiment of the present invention.

FIG. 2 shows a flow chart of the method for manufacturing the tantalum carbide according to the embodiment of the present invention.

In S1, a substrate 5 processed into an optional shape and made of tantalum or a tantalum alloy is placed in a vacuum heat treatment furnace 1. The substrate 5 is shown as a Ta substrate in FIG. 2.

In S2, the Ta substrate is heat-treated under a condition where a native oxide layer of $Ta_2O_5$ formed on the surface of the Ta substrate is sublimated.

In S3, $Ta_2O_5$ is completely sublimated and is removed from the surface of the Ta substrate.

In S4, a carbon source is introduced into the vacuum heat treatment furnace 1 after the infrared pyrometer 17 confirms that $Ta_2O_5$ is sublimated and removed.

Then, in S5, tantalum carbide starts to be formed on the surface of the Ta substrate.

The carbon source is continuously introduced from S4 to S8.

In the steps of S5 and S6, the tantalum carbide is formed by penetration of carbon into some areas of the Ta substrate, specifically the surface area. The tantalum carbide has a double-laminated structure where $Ta_2C$ and TaC are laminated in this order on the surface of the Ta substrate. A three layer structure of Ta, $Ta_2C$ and TaC including the Ta substrate is formed.

As usage, the manufacturing of the tantalum carbide may be finished at this stage where the Ta substrate remains.

When the carbon source is further continuously introduced, as shown in S7 and S8, the Ta substrate is lost by penetration of carbon into all areas of the Ta substrate, and only the tantalum carbide is produced.

In S7, penetration of carbon is not uniform, and the tantalum carbide has the double-laminated structure where $Ta_2C$ and TaC are laminated in this order.

In S8, in the tantalum carbide, the Ta substrate is transformed or reformed to TaC by almost uniform penetration of carbon into all areas of the Ta substrate. The manufacturing of the tantalum carbide is finished at this stage.

The tantalum carbide manufactured by the manufacturing method of the above embodiment is the tantalum carbide according to the embodiment.

Figure 3:
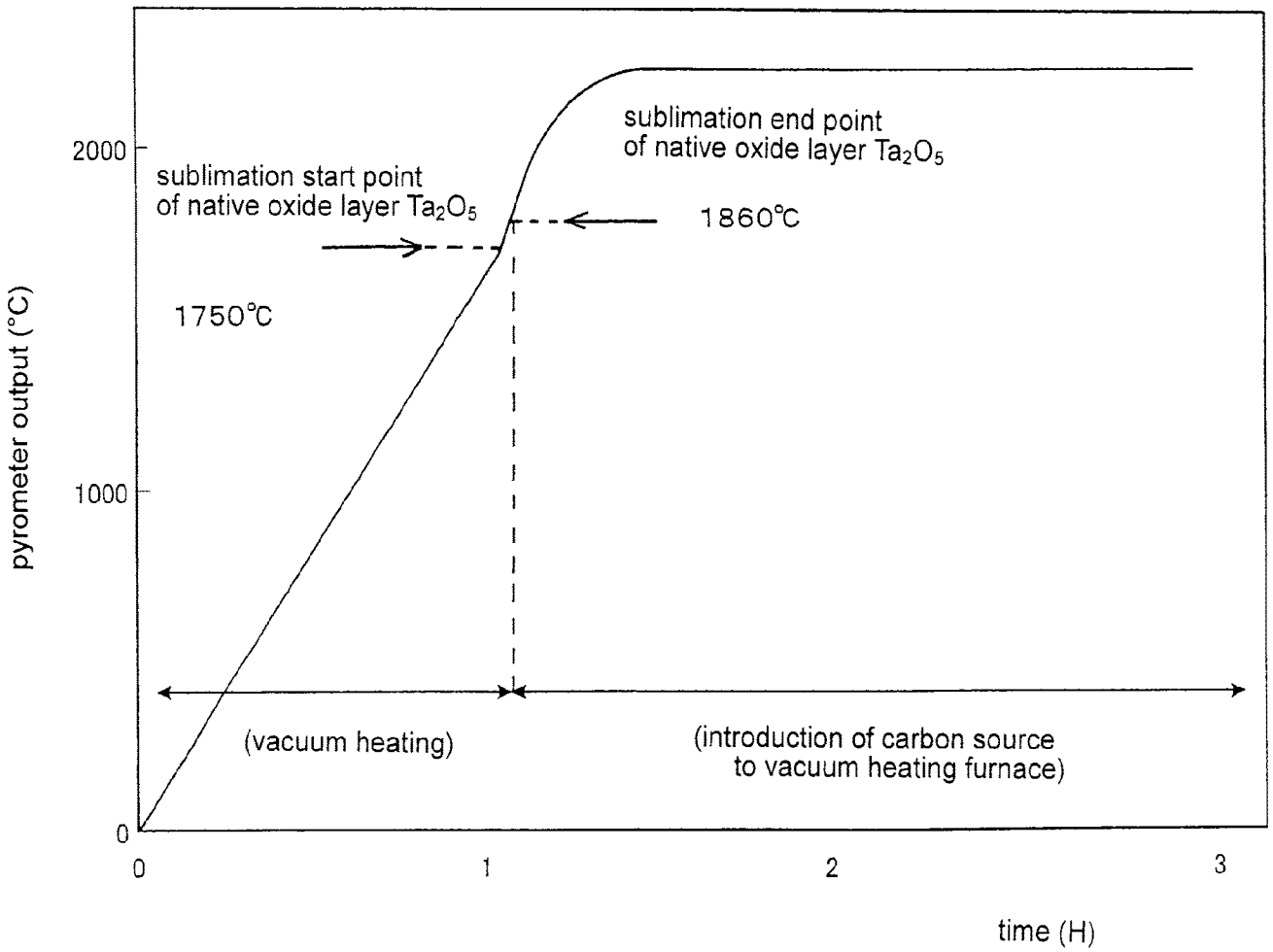
FIG. 3 is a view showing the output performance diagram of a pyrometer in the method for manufacturing the tantalum carbide according to the embodiment of the present invention.

FIG. 3 shows the output performance diagram of a pyrometer in the method for manufacturing the tantalum carbide according to the embodiment of the present invention. The sublimation can be detected by a curve where the output rises from approximately 1750° C. after the heating starts. It is considered this is because the native oxide layer formed on the surface is removed, and thereby the Ta or Ta alloy as the substrate is exposed and the emissivity of the surface is changed.

Thus, when the emissivity of the surface of the substrate 5 is measured by the pyrometer, the change of the emissivity when the native oxide layer of $Ta_2O_5$ is removed can be measured by the temperature change of the pyrometer, and the start and end of sublimation of $Ta_2O_5$ are known.

When the processing pressure is low, the preferable heat treatment condition where the native oxide layer of $Ta_2O_5$ is sublimated can be performed at a comparatively low temperature. However, so as to sublimate the surface native oxide layer securely, it is preferable that the native oxide layer is heat-treated in a range from approximately 1750° C. to 2000° C. under the pressure of approximately 1 Pa or lower, and more preferably from approximately 1860° C. to 2000° C. under the pressure of approximately 0.5 Pa or lower. By heat-treating the native oxide layer on this condition, the native oxide layer of $Ta_2O_5$ formed on the surface is securely sublimated and removed.

Referring to the preferable heat treatment condition for introducing the carbon source into the vacuum heat treatment furnace 1 after removing the native oxide layer of $Ta_2O_5$, and forming the tantalum carbide on the surface of the tantalum or tantalum alloy substrate 5, the temperature is in a range from approximately 1860° C. to 2500° C. under the pressure of approximately 1 Pa or lower. The temperature is more preferably in a range from approximately 2000° C. to 2500° C. under the pressure of approximately 0.5 Pa or lower.

When a resistance heating heater made of graphite is used for the heater in the heat treatment condition after removing the native oxide layer of $Ta_2O_5$, steam from the heater can serve as a carbon source. However, since the graphite heater is severely consumed under the manufacturing condition of the tantalum carbide according to the embodiment, it is preferable to place a carbon material used as the carbon source in the heat treatment chamber with the substrate 5 separately from the time soon after the output of the pyrometer is changed. Gas containing carbon can also be introduced.

Figure 4:
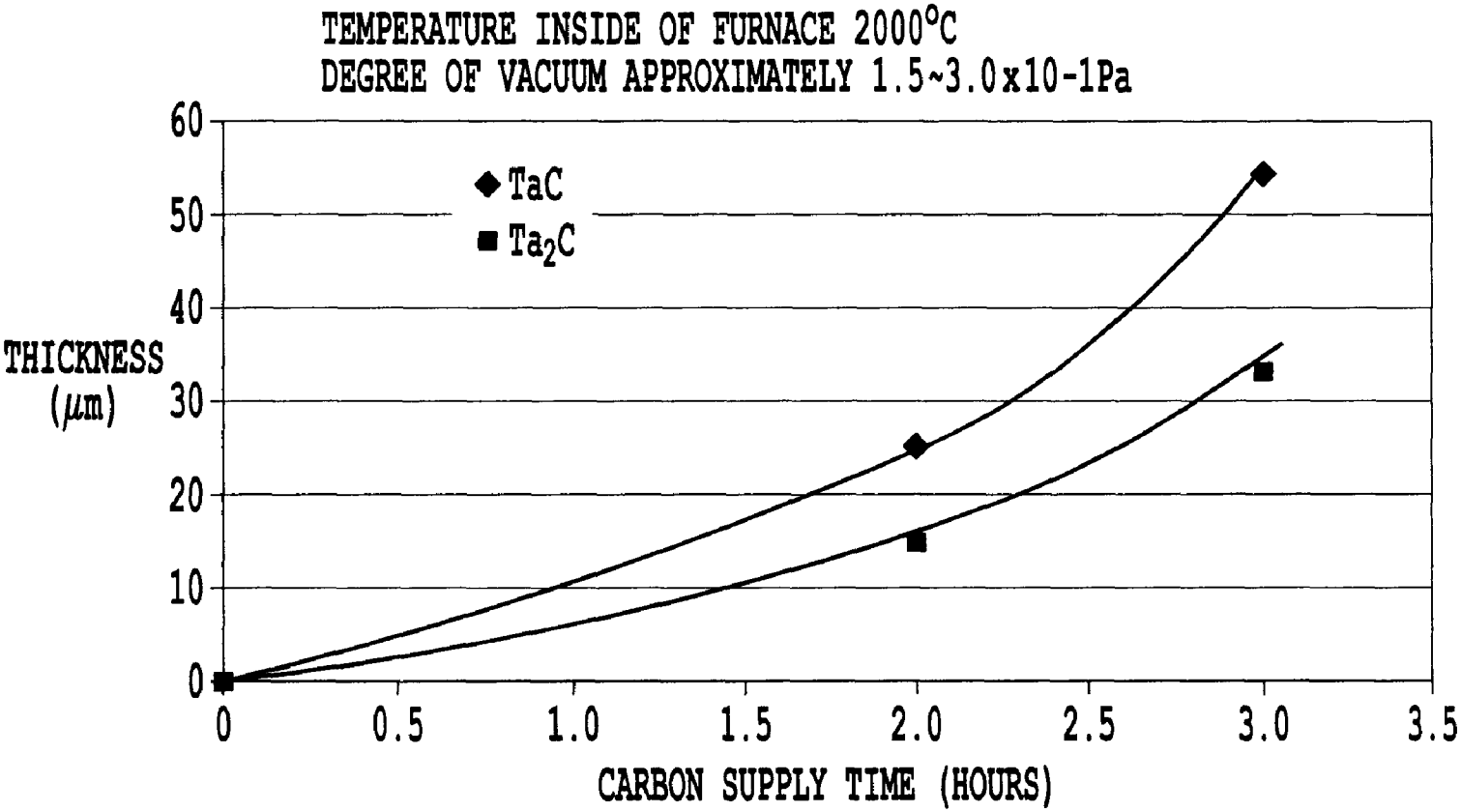
FIG. 4 is a view showing the thickness of the tantalum carbide and a heating time condition according to the embodiment of the present invention.
Figure 5:
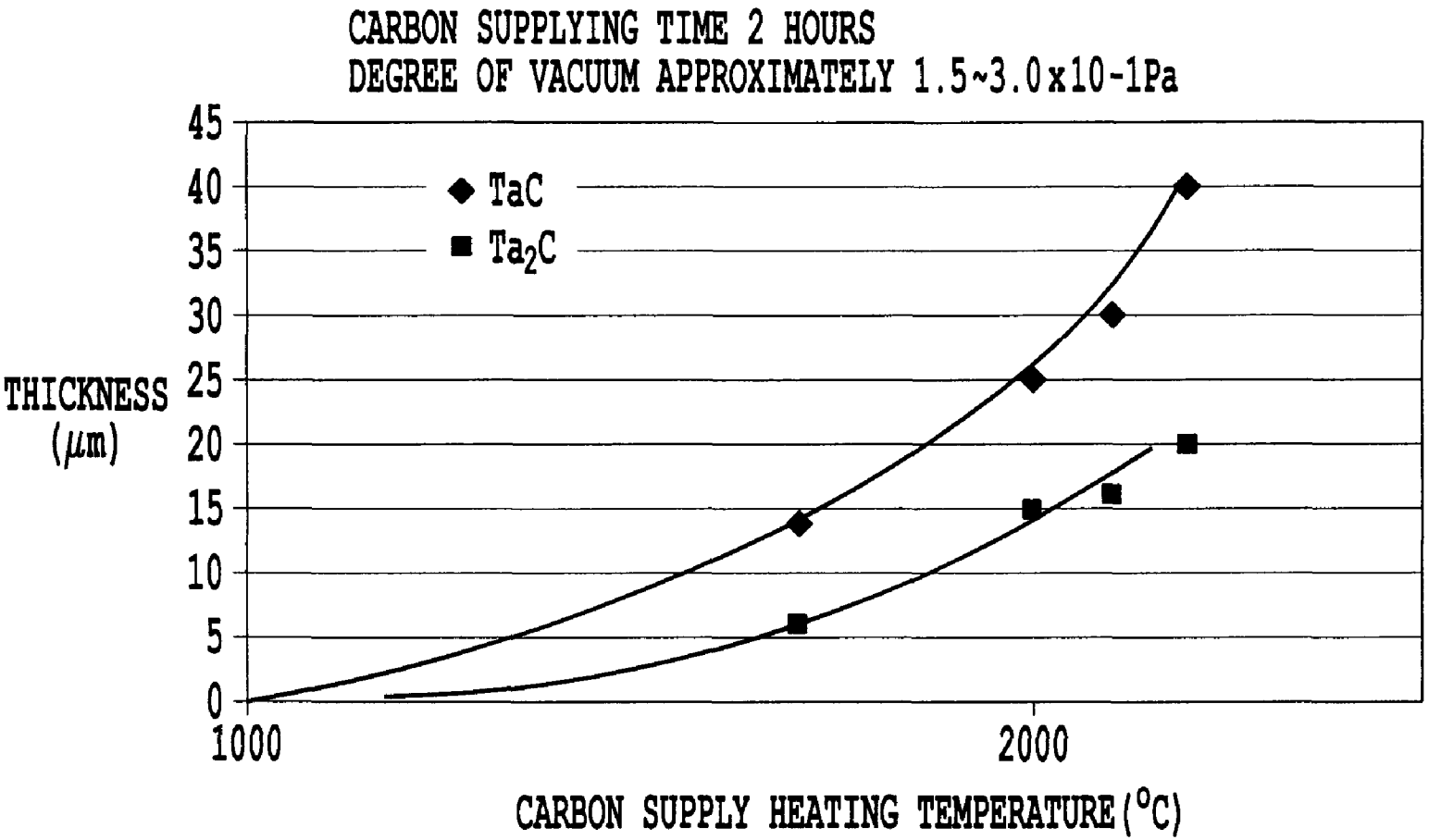
FIG. 5 is a view showing the thickness of the tantalum carbide and the heating temperature condition according to the embodiment of the present invention.

FIG. 4 shows the thickness of the tantalum carbide and a heating time condition according to the embodiment of the present invention. FIG. 5 shows the thickness of the tantalum carbide and the heating temperature condition according to the embodiment of the present invention.

Thereby, it is understood that the adjustment of the temperature, time and pressure conditions for heat-treating by introducing the carbon source into the vacuum heat treatment furnace 1 can control the thickness of the tantalum carbide capable of being formed. That is, the Ta or Ta alloy as the substrate 5 can also be completely transformed and reformed to TaC depending on the thickness of the Ta or Ta alloy used as the substrate 5.

In other words, when the Ta or Ta alloy is processed under the conditions of the manufacturing method of the tantalum carbide according to the embodiment after the Ta or Ta alloy is processed to a prescribed shape at the stage of the Ta or Ta alloy is comparatively and easily processed, TaC having a prescribed shape can be formed. Thereby, TaC can also be used as the electrode of the filament or heater.

When the tantalum or tantalum alloy patterned into a prescribed shape on the semiconductor substrate is processed under the conditions of the manufacturing method of the tantalum carbide according to the embodiment, TaC patterned into the prescribed shape can be formed.

Figure 6:
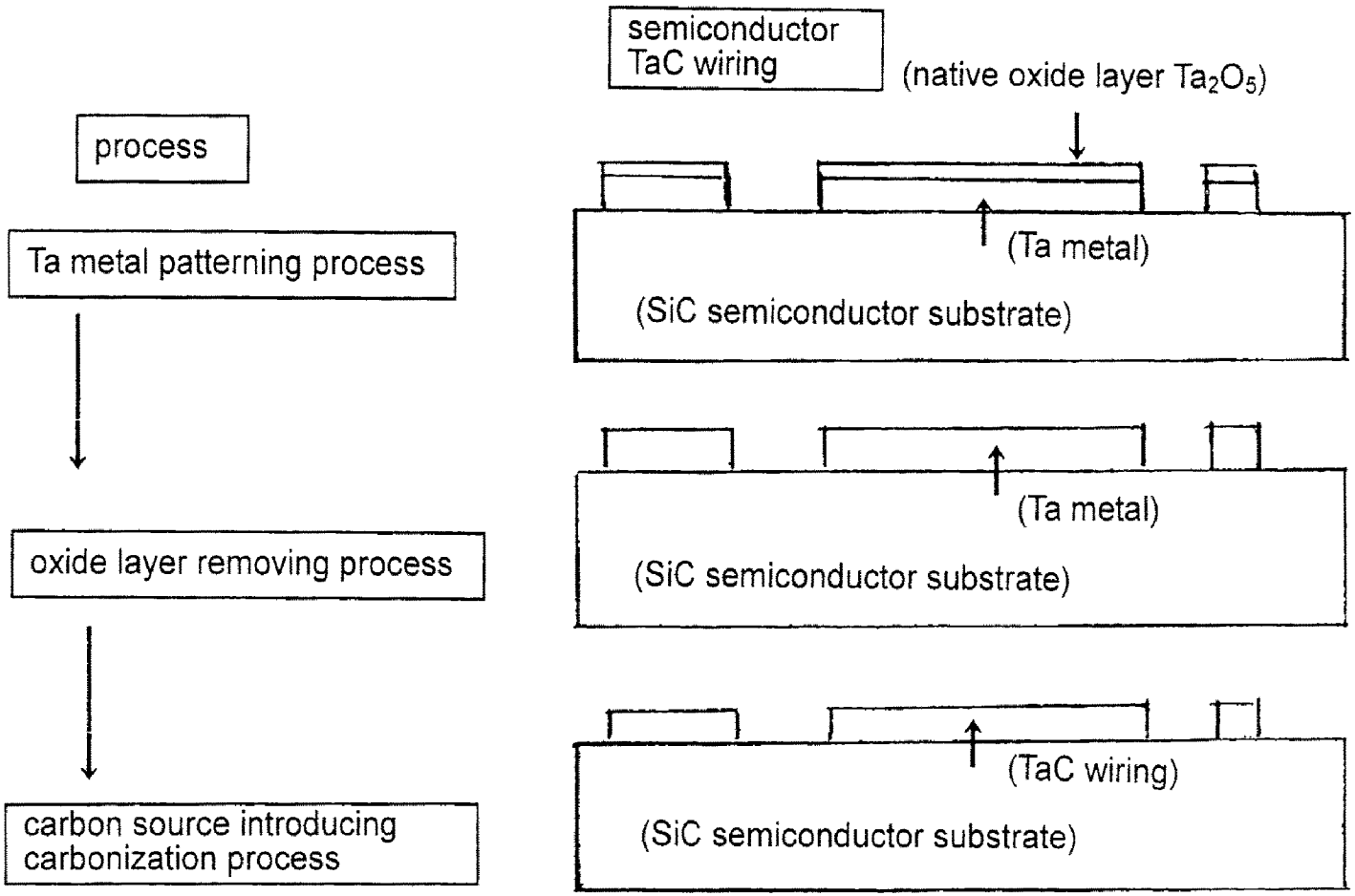
FIG. 6 is a view showing a flow chart for manufacturing a wiring of the tantalum carbide according to the embodiment of the present invention.

FIG. 6 shows a flow chart for manufacturing a wiring of the tantalum carbide according to the embodiment of the present invention.

The tantalum or tantalum alloy is patterned by an optional method such as a vapor deposition so that the tantalum or tantalum alloy has the prescribed shape, on the semiconductor substrate such as silicon carbide (hereinafter referred to as SiC), (Ta metal patterning process).

The native oxide layer of $Ta_2O_5$ formed on the surface of the patterned tantalum or patterned tantalum alloy is heat-treated under a condition where $Ta_2O_5$ is sublimated, and the $Ta_2O_5$ is removed from the surface of the patterned tantalum or patterned tantalum alloy (oxide layer removing process).

A wiring of tantalum carbide is formed by introducing the carbon source to heat-treat after the $Ta_2O_5$ is removed and by penetrating carbon from the surface of the patterned tantalum or patterned tantalum alloy (carbon source introducing carbonization process).

The adjustment of the temperature, time and pressure conditions for heat-treating by introducing the carbon source can produce a TaC wiring, as the wiring of the tantalum carbide, formed by the almost uniform penetration of carbon into all areas of the patterned tantalum or patterned tantalum alloy. In this case, a high-output semiconductor device where the TaC wiring is formed is produced.

The adjustment of the temperature, time and pressure conditions for heat-treating by introducing the carbon source can also produce a wiring of the tantalum carbide formed by penetration of carbon into some areas of the patterned tantalum or patterned tantalum alloy. In this case, the tantalum carbide has a laminated structure where $Ta_2C$ and TaC are laminated in this order on the surface of the patterned tantalum or patterned tantalum alloy.

Thus, the tantalum carbide such as TaC can be wired on the semiconductor substrate surface such as SiC.

Figure 7:
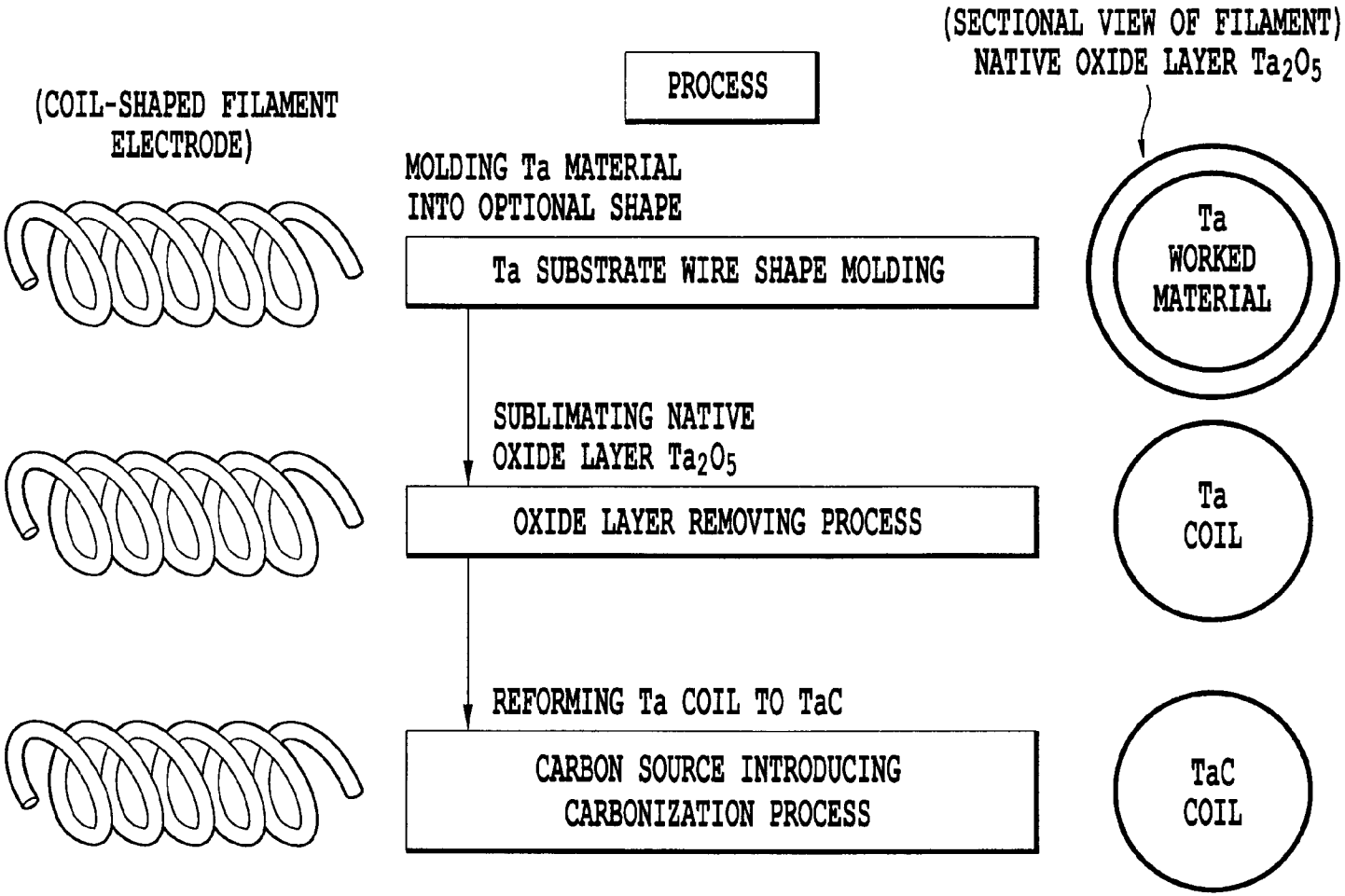
FIG. 7 is a view showing a flow chart for manufacturing an electrode of the tantalum carbide according to the embodiment of the present invention.

FIG. 7 shows a flow chart for manufacturing an electrode of the tantalum carbide according to the embodiment of the present invention.

The tantalum or tantalum alloy substrate is processed into a prescribed shape such as a coil shape, (Ta substrate wire shape molding).

The tantalum or tantalum alloy is heat-treated under the condition where the native oxide layer of $Ta_2O_5$ formed on the surface of the processed tantalum or processed tantalum alloy is sublimated, and the $Ta_2O_5$ is removed from the surface of the processed tantalum or processed tantalum alloy (oxide layer removing process).

After removing the oxide layer, the tantalum or tantalum alloy is heat-treated by introducing the carbon source, and carbon is made to penetrate from the surface of the tantalum or tantalum alloy to form the electrode of the tantalum carbide having the prescribed shape (carbon source introducing carbonization process).

The adjustment of the temperature, time and pressure conditions for heat-treating by introducing the carbon source can produce a TaC electrode, as the electrode of the tantalum carbide, formed by the almost uniform penetration of carbon into all areas of the tantalum or tantalum alloy processed into the prescribed shape.

The adjustment of the temperature, time and pressure conditions for heat-treating by introducing the carbon source can also produce the electrode of the tantalum carbide formed by penetration of carbon into some areas of the tantalum or tantalum alloy processed into the prescribed shape. In this case, the tantalum carbide has a laminated structure where $Ta_2C$ and TaC are laminated in this order on the surface of the tantalum or tantalum alloy processed into the prescribed shape.

Thus, the tantalum substrate can be used as the electrode of tantalum carbide such as TaC having the prescribed shape such as a filament and a heater.

Example 1

Ta as a sample was processed into a prescribed shape, and was placed in a container made of graphite. The Ta was heat-treated for 180 minutes on conditions that the temperature is from 1800° C. to 2300° C. and the degree of vacuum is from 1.5 to $3.0\times10^{-1}$ $^{Pa}$ in a heat treatment furnace having a resisted type heating heater made of graphite.

Figure 8:
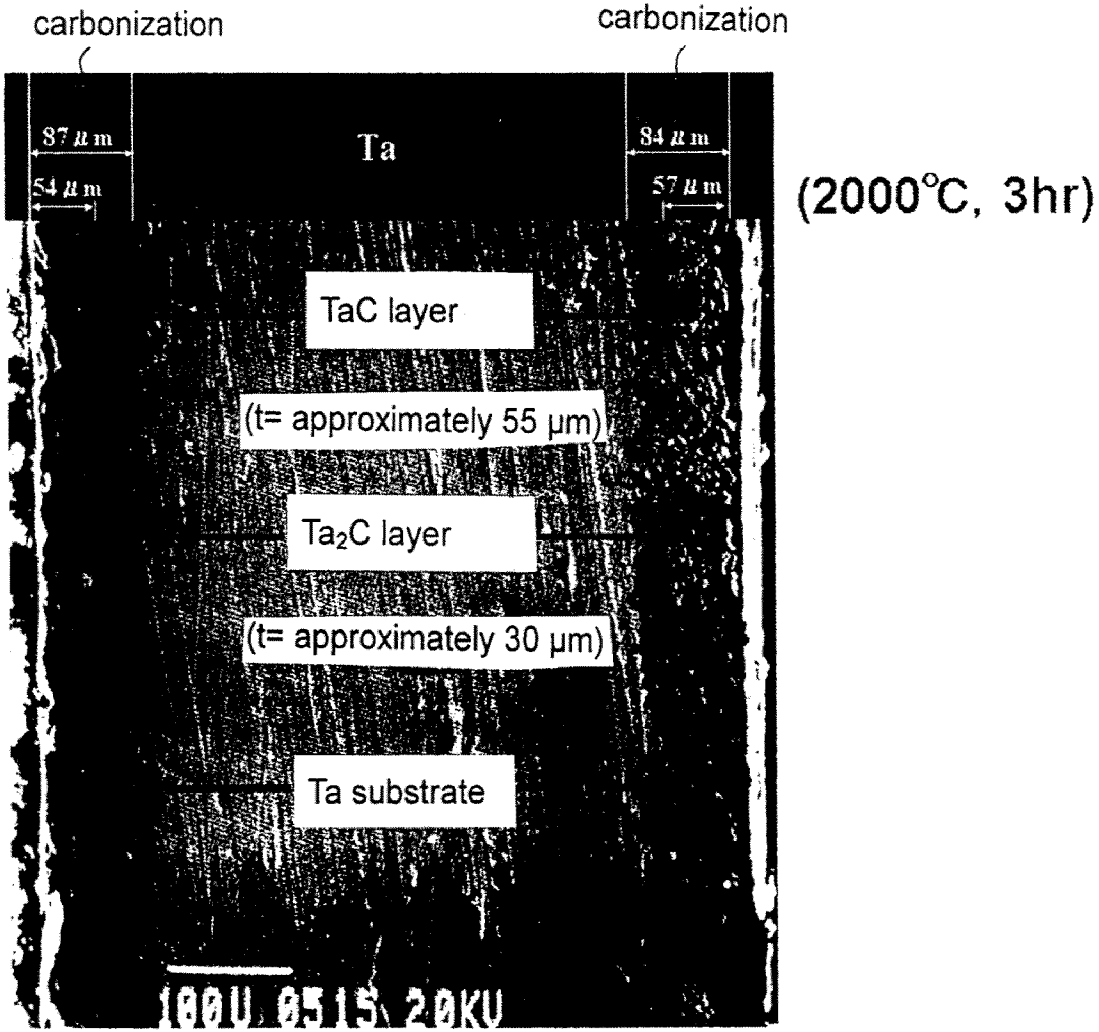
FIG. 8 is a view showing the enlarged section electron photomicrograph of the tantalum carbide according to the embodiment of the present invention, and showing the case of the tantalum carbide having a laminated structure.

FIG. 8 shows the enlarged section electron photomicrograph of the tantalum carbide manufactured by the above heat treatment condition. FIG. 8 is obtained after finishing the manufacturing of the tantalum carbide in S5 and S6 shown in FIG. 2, and shows the tantalum carbide having a laminated structure.

As shown in FIG. 8, carbon is diffused from the surface of Ta to the inside thereof, and a TaC layer is almost uniformly formed on a surface layer part. A $Ta_2C$ layer as an anchor layer (transition layer) for binding Ta and TaC appears on the inner surface of the TaC layer.

The tantalum carbide has a three layer structure where the Ta layer, the $Ta_2C$ layer, and the TaC layer are formed, and it can be observed that the boundary between the $Ta_2C$ layer and Ta, and the boundary between the $Ta_2C$ layer and the TaC layer are not clearly formed. Thereby, it is considered even if the thermal history is received, that the generation of cracks and exfoliation or the like in the TaC layer formed on the surface can be prevented unlike the TaC formed by the conventional method.

Since Ta, $Ta_2C$ and TaC have a different lattice constant respectively, it is considered that the lattice of each of the layers is compressed and the layers are laminated at the interfaces between the layers. Therefore, the delamination can also be prevented and the mechanical properties such as surface hardness can also be improved since the interface between the layers is very firmly formed.

Figure 9:
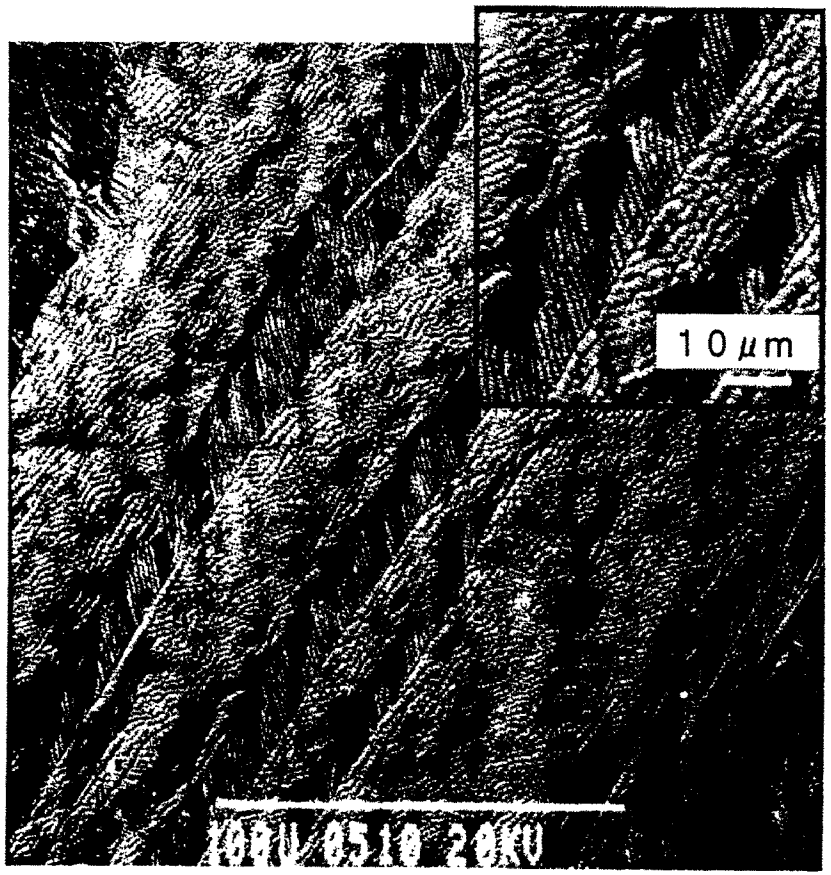
FIG. 9 is a view showing the surface enlarged electron photomicrograph of the tantalum carbide according to the embodiment of the present invention, and showing a TaC layer when the tantalum carbide has the laminated structure.
Figure 10:
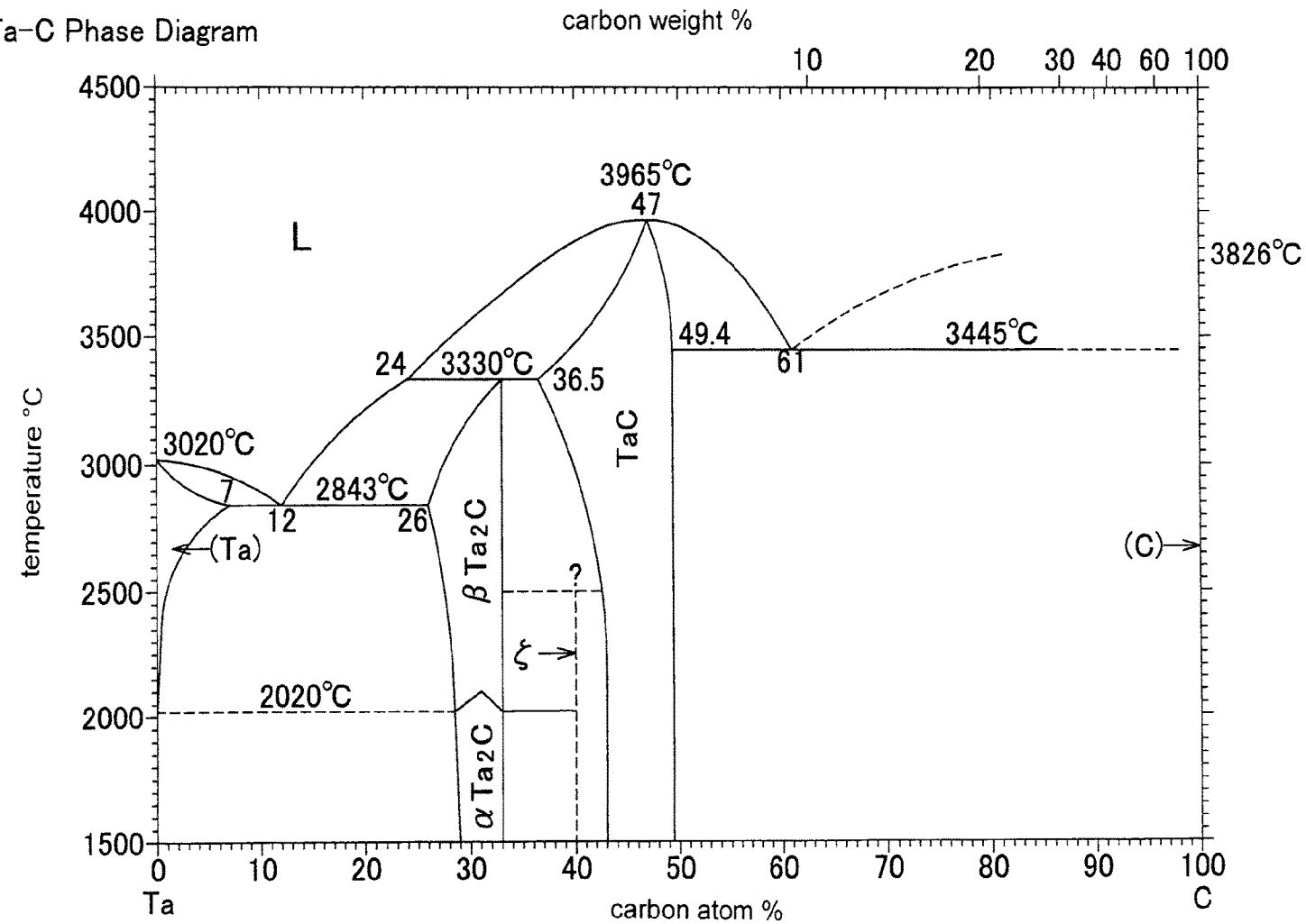
FIG. 10 is a view showing a phase diagram of TaC.

FIG. 9 shows the surface enlarged electron photomicrograph of the tantalum carbide of the tantalum carbide manufactured by the above heat treatment condition. Fibrous crystals are folded as shown in FIG. 9. The fibrous crystals grow in the same direction in the same layer, and there is a layer in which the other fibrous crystals grow in the direction different from the growing direction. One crystal structure is produced by the overlapping of the crystals.

The hardness value measured on the surface of TaC of the sample shown in FIG. 9 is 2200 Hv, and is considerably improved to the surface hardness of 1550 Hv of TaC manufactured by the conventional manufacturing method. It is considered that cross stripes formed on the surface of TaC contribute to properties improvement.

In the three-layer structure, a Ta substrate of a first layer is provided with high electrical conductivity and thermal conductivity of Ta. $Ta_2C$ of a second layer plays the role of prevention of interference layer like exfoliation and cracks. TaC of a third layer is provided with properties of a high melting point and high hardness, and the arrival of a high performance material is expected by a comprehensive synergistic effect. Therefore, the present invention can be applied for various uses such as machining tools and electronic materials.

Since the cross stripes formed on the surface are very fine as shown in FIG. 9, it is considered that the frictional resistance is also reduced. The present invention can also be used as a sliding material such as a bearing besides the semiconductor device having high resisting pressure and high output described above considering the high hardness of TaC. The present invention can also be used as a byte for machine processing using high hardness.

Thus, after the native oxide layer of $Ta_2O_5$ formed on the surface of the Ta or Ta alloy substrate is sublimated and removed in a vacuum at 1750° C. to 2000° C. in the method for manufacturing the tantalum carbide according to the embodiment, the carbon source is introduced into the vacuum, and TaC and $Ta_2C$ are formed on the surface of the Ta or Ta alloy substrate. The removal of the native oxide layer formed on the surface of the Ta substrate: $Ta_2O_5 \uparrow$ (sublimation disappearance at 1750° C. or more)

The introduction of the carbon source into the vacuum heating furnace:

$$Ta+C \rightarrow TaC$$

$$2Ta+C \rightarrow Ta_2C$$

Incidentally, after the carbon source is introduced into the vacuum at 1300° C. to 1600° C. to form TaC and $Ta_2C$ in the conventional process described in the Patent Document 8, the TaC and $Ta_2C$ is annealed in the vacuum at 1300° C. to 1600°

C. for a long period of time of approximately 15 hours, and unreacted carbon atoms adhered on the surface are diffused to grow the TaC layer.

The native oxide layer formed on the surface of the Ta substrate:

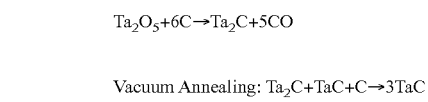

$$Ta_2O_5+7C \rightarrow 2TaC+5CO$$

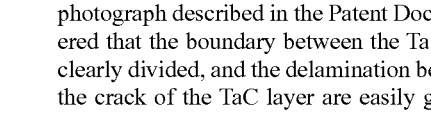

$$Ta_2O_5+6C \rightarrow Ta_2C+5CO$$

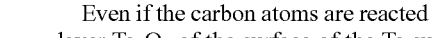

Vacuum Annealing: $Ta_2C+TaC+C \rightarrow 3TaC$

Therefore, as shown in the observation of the enlarged photograph described in the Patent Document 8, it is considered that the boundary between the Ta substrate and TaC is clearly divided, and the delamination between the layers and the crack of the TaC layer are easily generated by the heat stress repeatedly received.

Even if the carbon atoms are reacted with the native oxide layer $Ta_2O_5$ of the surface of the Ta substrate at a low temperature from 1300° C. to 1600° C., the native oxide layer $Ta_2O_5$ is chemically stable, the carbonization speed of Ta is low, and the diffusion depth of the carbon atoms is very shallow. Thereby, even if the carbon atoms are diffused by performing the vacuum heating annealing for tens of hours to grow the TaC layer, a desired thickness is not obtained. Simultaneously, crystal grains grow greatly by heating for a long period of time to be formed in a bulk shape, and the boundary is also larger. It is considered that the boundary between the Ta substrate and TaC is clearly divided, and the delamination between the layers and the crack in the TaC layer are easily generated.

Although the present invention is described in the above preferable embodiment, the present invention is not limited thereto. It will be understood that other various embodiments can be performed without departing from the spirit and scope of the present invention.

INDUSTRIAL APPLICABILITY

According to the manufacturing method of the tantalum carbide according to the present invention, the tantalum carbide can be securely manufactured by a simple method, and the present invention has various industrial applicabilities such as bytes for machine processing, and electrodes or the like used as filaments for lighting or the like and heaters in addition to a heat treatment jig using the excellent chemical properties.

What is claimed is:

1. A method for manufacturing a tantalum carbide, comprising:

placing tantalum or a tantalum alloy in a vacuum heat treatment furnace;

heat-treating the tantalum or tantalum alloy under a condition wherein a native oxide layer of $Ta_2O_5$ formed on a surface of the tantalum or tantalum alloy is sublimated to remove the $Ta_2O_5$; and after removing the $Ta_2O_5$, heat-treating the tantalum or tantalum alloy by introducing a carbon source into the vacuum heat treatment furnace to form the tantalum carbide from the surface of the tantalum or tantalum alloy.

2. The method for manufacturing the tantalum carbide according to claim 1, wherein the tantalum carbide is TaC formed by penetration of carbon into all areas of the tantalum or tantalum alloy.

3. The method for manufacturing the tantalum carbide according to claim 1, wherein the tantalum carbide is formed by penetration of carbon into some areas of the tantalum or tantalum alloy, and the tantalum carbide has a laminated structure where $Ta_2C$ and TaC are laminated in the order on the surface of the tantalum or tantalum alloy.

4. The method for manufacturing the tantalum carbide according to claim 1, wherein the method is a heat treatment method for measuring a change of an emissivity when the native oxide layer is removed by a pyrometer.

5. The method for manufacturing the tantalum carbide according to claim 1, wherein a thickness of the tantalum carbide capable of being formed is controlled by adjusting temperature, time and pressure conditions for introducing the carbon source into the vacuum heat treatment furnace and heat-treating the tantalum or tantalum alloy processed into an optional shape.

6. The method for manufacturing the tantalum carbide according to claim 1, wherein the heat treatment condition under a condition where the native oxide layer of $Ta_2O_5$ is sublimated is at a temperature in a range from 1750° C. to 2000° C. and a pressure of 1 Pa or lower.

7. The method for manufacturing the tantalum carbide according to claim 1, wherein the heat treatment condition for introducing the carbon source into the vacuum heat treatment furnace to form the tantalum carbide on the surface of the tantalum or tantalum alloy is a temperature from 1860° C. to 2500° C., and a pressure of 1 Pa or lower.

* * * * *